US005552679A

United States Patent [19]

Murasko

[11] Patent Number: 5,552,679

[45] Date of Patent: Sep. 3, 1996

[54] ELECTROLUMINESCENT AND LIGHT REFLECTIVE PANEL

[75] Inventor: Matthew M. Murasko, Manhattan Beach, Calif.

[73] Assignee: International En-R-Tech Incorporated, British Columbia, Canada

[21] Appl. No.: 425,335

[22] Filed: Apr. 18, 1995

Related U.S. Application Data

[63] Continuation of Ser. No. 92,013, Jul. 15, 1993, abandoned.

[51] Int. Cl.[6] ..... G09G 3/10

[52] U.S. Cl. ..... 315/169.3; 313/506; 359/528

[58] Field of Search ..... 315/169.3, 209 R; 313/463, 473, 506, 509, 511; 359/528

[56] References Cited

U.S. PATENT DOCUMENTS

| | | | |
|---|---|---|---|
| D. 310,434 | 9/1990 | Breece . | |
| D. 326,924 | 6/1992 | Carroll . | |
| 3,317,722 | 5/1967 | Whitney . | |
| 3,648,235 | 3/1972 | Cahill . | |
| 3,793,517 | 2/1974 | Carlini . | |
| 4,020,389 | 4/1977 | Dickson et al. . | |
| 4,195,328 | 3/1980 | Harris, Jr. . | |
| 4,234,907 | 11/1980 | Daniel . | |
| 4,266,164 | 5/1981 | Schroeder | 315/169.1 |
| 4,319,308 | 3/1982 | Ippoliti . | |
| 4,480,293 | 10/1984 | Wells . | |
| 4,570,206 | 2/1986 | Deutsch . | |
| 4,652,981 | 3/1987 | Glynn . | |
| 4,667,274 | 5/1987 | Daniel . | |
| 4,709,307 | 11/1987 | Branom . | |
| 4,748,375 | 5/1988 | Lindmayer . | |
| 4,862,331 | 8/1989 | Hanabusa . | |
| 4,875,144 | 10/1989 | Wainwright . | |
| 4,877,995 | 10/1989 | Thioulouse et al. . | |
| 4,901,211 | 2/1990 | Shen . | |
| 4,945,458 | 7/1990 | Batts et al. . | |
| 4,956,752 | 9/1990 | Foglietti . | |
| 4,999,936 | 3/1991 | Calamia et al. . | |
| 5,019,438 | 5/1991 | Rapisarda . | |
| 5,040,099 | 8/1991 | Harris . | |
| 5,067,063 | 11/1991 | Granneman et al. . | |
| 5,111,366 | 5/1992 | Rife et al. . | |
| 5,122,939 | 6/1992 | Kazdan et al. . | |
| 5,138,539 | 8/1992 | Honda et al. . | |
| 5,151,678 | 9/1992 | Veltri et al. . | |

FOREIGN PATENT DOCUMENTS

| | | | |
|---|---|---|---|
| 2025124 | 1/1980 | United Kingdom | 313/473 |

*Primary Examiner*—Robert Pascal
*Assistant Examiner*—Darius Gambino
*Attorney, Agent, or Firm*—Fulwider Patton Lee & Utecht

[57] ABSTRACT

An illumination system with a panel that is capable of producing electroluminescence as well as reflecting incident light independent of the electroluminescence function of the panel. A layer of phosphor is excited by a power source, and a reflective layer disposed on top of the phosphor layer reflects incident light from an outside light source. The reflective layer is transparent and does not interfere with the electroluminescence of the panel.

7 Claims, 1 Drawing Sheet

ELECTROLUMINESCENT AND LIGHT REFLECTIVE PANEL

This application is a continuation of application Ser. No. 08/092/013, filed Jul. 15, 1993 now abandoned.

BACKGROUND OF THE INVENTION

1. Field of the Invention

This invention generally relates to electroluminescent light emitting panels and reflective strips for use in various products for purposes such as enhancing visibility, safety, and appearance.

2. Description of Related Art

Electroluminescent panels (also known as electroluminescent lamps or tapes) are surface-area light sources wherein light is produced by exciting an electroluminescent phosphor, typically by an electric field. A suitable phosphor is placed between two metallic sheet surfaces forming two electrode layers, one of which is essentially transparent, and an alternating current is applied to the electrode layers in order to excite the phosphor material to produce light. The outer surface of the non-transparent electrode layer is covered by a non-conductive layer of material. The entire structure is typically sealed by a protective material (e.g., ACLAR™) that is impervious to moisture or other outside influences that may interfere with its operation. Such electroluminescent panels are typically formed of elongate, flexible strips of laminated material that are adaptable for use in many different shapes and sizes. Furthermore, by choosing a particular phosphor, these panels are capable of producing light in several colors such as white, yellow, green, or blue.

Electroluminescent panels have been available for use in connection with a number of different products such as articles of clothing (e.g., jackets), handbags, belts, and lamps. Some of the reasons for using electroluminescent panels are their ability to provide highly visible sources of uniform light in various bright colors, their ability to emit cool light without creating noticeable heat or substantial current drain, their ability to improve safety by wearing, placing, or carrying a visible item that attracts viewers' attention, and their appearance as a decorative or novelty item.

However, presently available electroluminescent panels lack the capability of reflecting incident light emitted from an outside light source. The only light emitting effect in these panels is caused by the excitation of phosphor embedded therein in response to the surrounding electric field. An added reflective capability that does not interfere with the electroluminescence feature of such a panel would greatly enhance its functionality, since regardless of whether the panel is in the ON or OFF mode (or even if the power supply is drained), the panel would be visible when an outside source (e.g., automobile headlights, flashlight) imparts light thereon.

One attempt at solving this problem can be found in U.S. Pat. No. 5,151,678, issued to Veltri et al., wherein a reflective strip is located on either side of an electroluminescent strip used in a safety belt. This patent discloses that the reflective strip enhances the illuminating function of the belt by acting as a reflective strip for light contacting the belt from other sources as well as serving as a reflective surface for light illuminating from the electroluminescent strip. Although the addition of a separate reflective strip such as the kind disclosed in the above-mentioned patent may provide reflective characteristics to the safety belt, nevertheless the electroluminescent strip still does not possess reflective characteristics of its own.

Thus, what has been needed and heretofore unavailable is an illumination system with a panel that in addition to electroluminescence, has light reflection capabilities. The present invention fulfills this need.

SUMMARY OF THE INVENTION

This invention is directed to an illumination system which can emit electroluminescent light as well as reflect incident light received from an outside light source. The present invention enhances illumination capabilities of a conventional electroluminescent panel by adding a reflective capability that is independent of whether the panel is in the ON or OFF mode and does not interfere with the electroluminescence of the panel. By adding a reflective feature to conventional electroluminescent panels, they become visible when an outside light source imparts light on the surface of the panel.

The illumination system in accordance with the present invention includes a laminated panel formed by six layers of material, namely a rear insulator layer, a rear electrode layer, a dielectric layer, a phosphor layer, a transparent front electrode layer, and a transparent reflective film layer.

The illumination of the phosphor layer is achieved by an external source which sufficiently excites the phosphor to emit light. One example of such an external source is an alternating current power source which provides a sufficiently high voltage and frequency rating. For this purpose, a DC (direct current) power supply having a specific voltage is connected to an inverter which converts DC to AC (alternating current) power while boosting the voltage and the frequency rating. The inverter's output is from about 30 to about 240 volts with a frequency of about 400 to about 4000 Hz. The AC power is directed to the laminated panel via electrical connections between the inverter and the front and rear electrode layers. An electrical control switch (e.g., an ON/OFF switch, a dimmer switch, etc.), electrically connected between the DC power supply and the DC to AC inverter, is used to activate the electrode layers which in turn generate an electric field around the phosphor layer, thereby causing excitation and illumination of the phosphor.

In addition to electroluminescent capabilities, a transparent reflective film layer disposed on top of the transparent front electrode layer provides a desirable reflective characteristic to the illumination panel without interfering with the electroluminescence functions of the panel. The reflective function is activated whenever incident light reaches the panel from an outside light source. Therefore, the panel is capable of serving an important dual purpose; i.e., on-demand illumination by excitation of the phosphor layer, and reflection of incident light from an outside light source independent of the phosphor illumination.

The laminated panel of the present invention is highly resistant to thermal shock and cycling, and is breathable which allows moisture to enter and exit the panel with no obvious negative effects on performance. Unlike existing electroluminescent panels, such qualities are achieved in the present invention without encapsulating the panel in ACLAR™ which is an expensive material that in turn increases the cost of the panel and limits the freedom of design. Instead, the phosphor particles used in the present invention are microencapsulated according to a process which is used in a commercially available electroluminescent panel known as the QUANTAFLEX 1400™, sold by MKS, Inc. of Bridgeton, N.J. The microencapsulation process allows the phosphor particles to be selectively placed (preferably by screen printing it on a substrate) to create a logo or icon which can emit light.

As compared to conventional methods of making electroluminescent panels which deposit phosphor over standard patterns such as rectangles and squares, this encapsulation method allows the direct surface area of a desired logo or icon to be illuminated, thereby saving valuable battery life and reducing power consumption. Also, the elimination of ACLAR™ (used for encapsulation in prior art panels) from the edges of the panel and the use of the microencapsulation process enables the panel of the present invention to illuminate its entire surface, including the edges. In addition, the panel of the present invention is very thin, lightweight, flat, durable, and highly flexible. Furthermore, the panel of the invention may produce various bright colors which are limited only by the choice of the particular phosphor used in the panel. Such qualities make the present invention highly versatile and adaptable for use in many applications for increasing safety, visibility, promoting brand awareness and providing novelty items. The present invention can be inexpensively mass produced in many different configurations and sizes, and can be applied as an add-on feature to an existing product or can be implemented during the manufacturing of a product.

From the above, it may be seen that the present invention provides important advantages over conventional electroluminescent panels and reflective strips known in the art. Other features and advantages of the invention will become more apparent from the following detailed description and drawings which will illustrate, by way of example, the features of the invention.

DETAILED DESCRIPTION OF THE PREFERRED EMBODIMENTS

Figure 1:
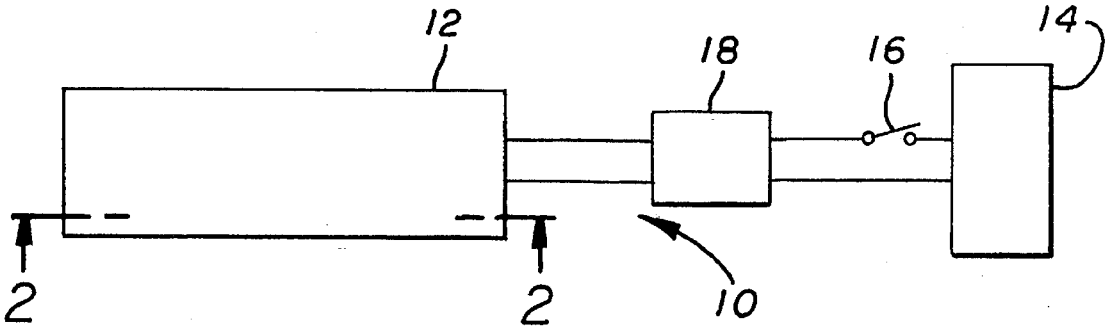
FIG. 1 is a block diagram of an illumination system embodying features of the invention.
Figure 2:
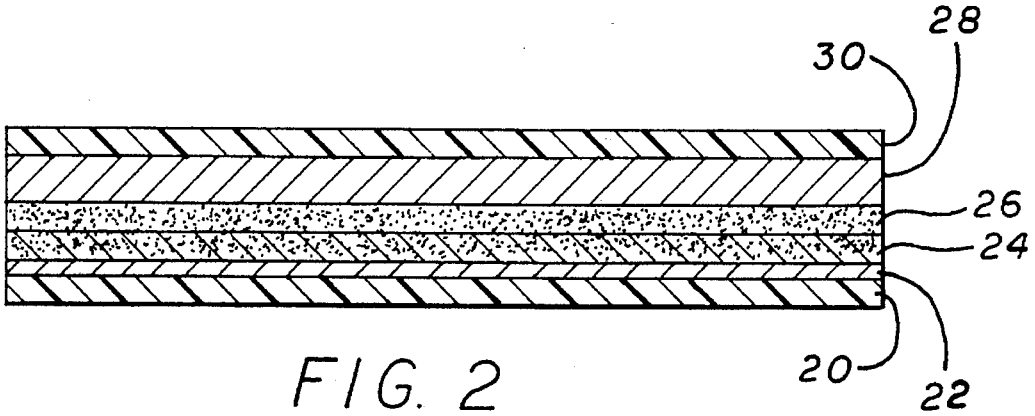
FIG. 2 is a cross-sectional view of the illumination panel of the illumination system shown in FIG. 1, taken along lines 2—2.

FIGS. 1 and 2 illustrate an improved illumination system that is capable of producing electroluminescent light as well as reflecting oncoming light from an outside source without interfering with the electroluminescent function of the system. Referring to FIG. 1, the illumination system 10 of the present invention includes an illumination panel 12, a power source 14, a control switch 16 and an inverter 18.

FIG. 2 illustrates the illumination panel 12 which consists of various layers of elongated strips of material disposed one on top of another in a laminated structure. Rear insulator layer 20 is a flat surface which can be made of plastic or polyester substrate. A rear electrode layer 22 which is made of a metallic or otherwise electrically conductive material (preferably made of Silver Oxide) is printed or otherwise disposed on rear insulator layer 20. A dielectric layer 24 is disposed on top of rear electrode layer 22 so as to provide a nonconducting layer of material for the purpose of providing a neutral substrate for the phosphor layer and for maintaining an electric field with a minimum dissipation of power. A phosphor layer 26 is next printed or otherwise disposed on top of dielectric layer 24. Depending upon the particular phosphor chosen, various colors such as white, yellow, green, or blue may be emitted by the phosphor layer. A transparent front electrode layer 28, preferably formed of a polyester substrate (preferably Indium Tin Oxide), is disposed on phosphor layer 26. As will be explained below, rear electrode layer 22 and transparent front electrode layer 28 provide an electric field around phosphor layer 26 to excite the phosphor, thereby resulting in luminescence.

The reflective quality of panel 12 is achieved by having a transparent reflective film layer 30 disposed on transparent front electrode layer 28. Reflective film layer 30 reflects light coming from a light source such as a flashlight, street light, or automobile headlight, and at the same time allows the electroluminescence of phosphor layer 26 to be visible to an observer. In the present invention, the reflective function is totally independent of the electroluminescent function of panel 12. All of the above-mentioned layers 20, 22, 24, 26, 28, and 30 can be laminated by various methods such as heat bonding or use of adhesives as long as the chosen method does not interfere with the operation of panel 12. If an adhesive is used to bond the various layers, there are certain criteria that must be followed in choosing a proper adhesive. Specifically, the adhesive used between rear electrode layer 22 and dielectric layer 24, between dielectric layer 24 and phosphor layer 26, and between phosphor layer 26 and transparent front electrode layer 28 must be electrically conductive. Also, the adhesive used between phosphor layer 26 and transparent front electrode layer 28, and between transparent front electrode layer 28 and transparent reflective film layer 30 must be transparent. The panel of the invention can be made so as to have a thickness of about 0.002 to about 0.012 inches.

The electroluminescence of panel 12 is achieved by providing alternating current to rear electrode layer 22 and transparent front electrode layer 28. For this purpose, FIG. 1 illustrates a power source 14 connected to an inverter 18 with the output of inverter 18 being directed to rear and front electrode layers 22 and 28. Presently, electroluminescent panels are designed to operate on AC power, and use of DC power is not practical. Therefore, power source 14 is preferably a DC power source such as a battery, and inverter 18 is preferably a DC to AC inverter for changing the output of DC power source 14 to AC power before directing the power to panel 12. If, however, electroluminescent panels using direct current become practical, a DC to AC inverter will not be necessary, and power source 14 could be a DC power source with its output directly connected to rear and front electrode layers 22 and 28.

Control switch 16 is placed between power source 14 and inverter 18 in order to allow the user of panel 12 to selectively turn the electroluminescent function to ON or OFF positions. Control switch 16 may be a two-position ON/OFF switch, a dimmer switch, a slide switch, a switch capable of causing on and off flashing, a remote control switch, or any other control switch that may cause the desirable effect. Control switch 16 may also be a manually operated switch or an automatic switch that has been preprogrammed to activate and deactivate panel 12 in response to certain conditions such as the onset of darkness.

Figure 3:
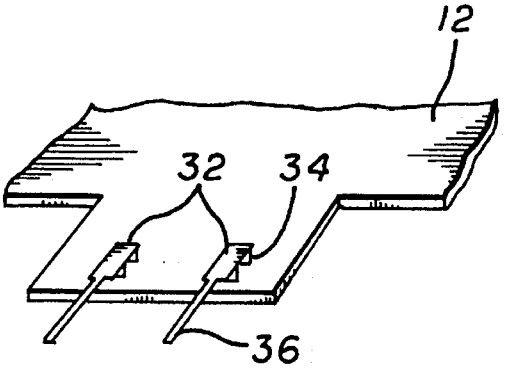
FIG. 3 is a perspective view of a crimp connection method for connecting a pair of leads to the illumination panel of the illumination system shown in FIG. 1.

FIG. 3 illustrates the preferred crimp method for connecting wire leads to the panel of the present invention, wherein a pair of conductive connectors 32 with penetrating teeth 34 are directed into panel 12 so that one of the connectors makes contact with electrode layer 22 and the other connector makes contact with electrode layer 28. Each connector 32 has a lead 36 that extends therefrom so that each lead 36 can make contact with one of the two output terminals of inverter 18.

As can be appreciated, the present invention provides for a new capability in conventional electroluminescent panels; i.e., the ability to reflect light independently and without interfering with the electroluminescence of the panel. This substantially improves the functionality, practicality, safety, visibility, and novelty associated with the use of such panels in many different applications. While a particular form of the invention has been illustrated and described, it will also be apparent that various modifications can be made to the present invention without departing from the spirit and scope thereof.

What is claimed is:

1. An electroluminescent and light reflective illumination panel, comprising:

a flexible insulator layer of electrically non-conducting material;

a flexible electrode layer of electrically conductive material disposed on said layer of electrically insulating material;

a flexible dielectric layer of electrically non-conducting material disposed on said electrode layer;

a flexible layer of microencapsulated phosphor particles disposed on said dielectric layer;

a flexible second electrode layer of electrically conductive material disposed on said layer of microencapsulated phosphor particles, said second electrode layer being substantially transparent;

a flexible layer of reflective film disposed on said second electrode layer, said layer of reflective film being transparent; and said layers being pervious to moisture.

2. The illumination panel of claim 1, wherein said flexible layer of microencapsulated phosphor particles comprises microencapsulated phosphor particles selectively placed on a flexible substrate.

3. The illumination panel of claim 1, wherein said layers are laminated together.

4. The illumination panel of claim 1, wherein said layers are laminated together by a heat compression process.

5. The illumination panel of claim 1, wherein said layers are laminated together by transparent electrically conductive adhesive applied between said layers.

6. The illumination panel of claim 1, wherein said panel has a thickness of about 0.002 inches to about 0.012 inches.

7. The illumination panel of claim 1, further comprising means for providing alternating electric current to said panel connected to said first and second electrode layers.

* * * * *